US009478882B1

(12) United States Patent
Schmidt et al.

(10) Patent No.: US 9,478,882 B1
(45) Date of Patent: Oct. 25, 2016

(54) HAZARD DETECTOR ELECTRICAL CONNECTOR FOR EASY USER MANIPULATION AND ATMOSPHERIC ISOLATION

(71) Applicant: GOOGLE INC., Mountain View, CA (US)

(72) Inventors: Mathias Schmidt, Emeryville, CA (US); Adam Mittleman, Redwood City, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 14/713,589

(22) Filed: May 15, 2015

(51) Int. Cl.

| | |
|---|---|
| ***H01R 13/73*** | (2006.01) |
| ***H01R 12/70*** | (2011.01) |
| ***H01R 13/52*** | (2006.01) |
| ***G08B 17/10*** | (2006.01) |

(52) U.S. Cl.
CPC ..... *H01R 12/7076* (2013.01); *G08B 17/10* (2013.01); *H01R 13/52* (2013.01); *H01R 13/73* (2013.01)

(58) Field of Classification Search
CPC .. H01R 12/7076; H01R 13/73; H01R 13/74; H01R 13/741; H01R 13/743; H01R 13/639; H01R 13/6392
USPC ..... 439/767, 660, 566, 559, 358, 357, 353, 439/78, 676
See application file for complete search history.

(56) References Cited

U.S. PATENT DOCUMENTS

| | | | | |
|---|---|---|---|---|
| 4,257,039 | A * | 3/1981 | Webb | G08B 17/113 250/381 |
| 6,113,424 | A * | 9/2000 | Shinozaki | H01R 13/5202 439/556 |
| 6,508,666 | B1 * | 1/2003 | Francis | H01R 13/745 439/282 |
| 8,847,772 | B2 | 9/2014 | Marks et al. | |
| 2004/0125571 | A1 * | 7/2004 | Chen | H05K 7/1427 361/715 |
| 2008/0299811 | A1 * | 12/2008 | Battista | H01R 13/6273 439/345 |
| 2013/0093594 | A1 * | 4/2013 | Brigham | G08B 17/10 340/628 |

* cited by examiner

*Primary Examiner* — Abdullah Riyami
*Assistant Examiner* — Harshad Patel
(74) *Attorney, Agent, or Firm* — Kilpatrick Townsend & Stockton LLP

(57) ABSTRACT

An electrical connector for a hazard detector includes a socket body that includes four lateral walls, a rear wall, a catch feature and a catch support; the lateral walls adjoin one another and the rear wall, continuously and airtightly along edges thereof. The catch support adjoins two of the lateral walls along edges of the catch support to define a catch cavity and a plug cavity on opposing sides of the catch support. A first side of the rear wall faces the plug cavity and a second side bounds a rear surface of the socket body. The catch feature couples with the catch support. Electrical pins pass through the rear wall of the socket body such that one end of each of the pins is within the plug cavity, and an opposing end of each of the pins extends away from the rear surface of the socket body.

20 Claims, 11 Drawing Sheets

FIG. 8A
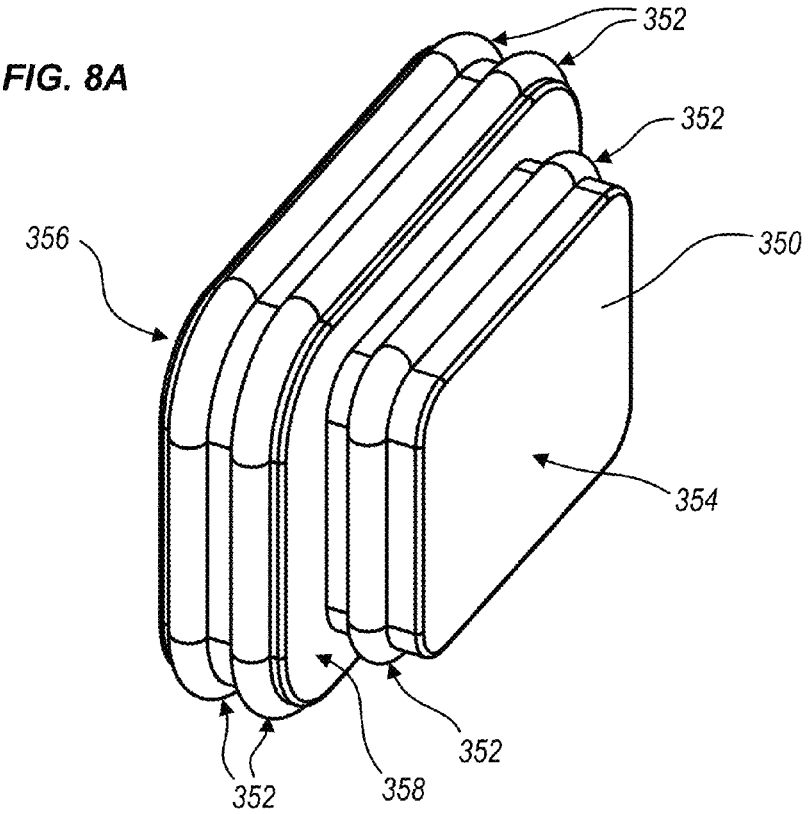
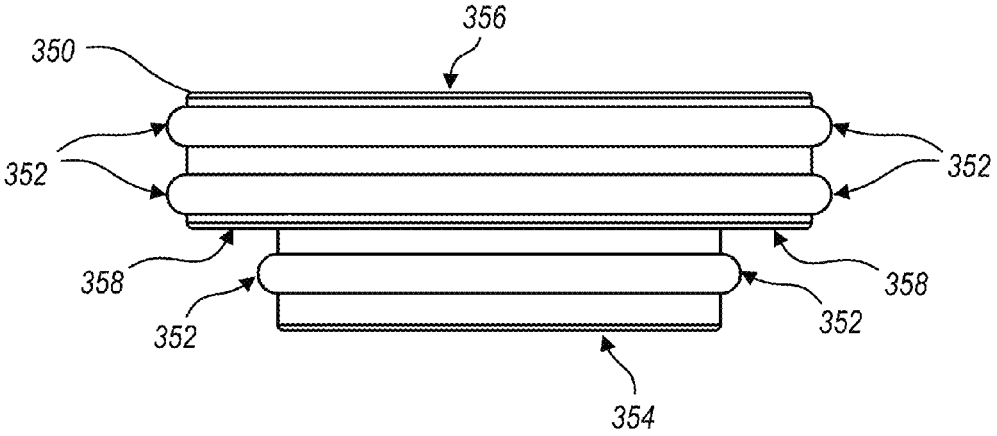
FIG. 8B

HAZARD DETECTOR ELECTRICAL CONNECTOR FOR EASY USER MANIPULATION AND ATMOSPHERIC ISOLATION

BACKGROUND

In some forms of hazard detectors, such as optical smoke detectors, a smoke chamber is used for creating a controlled environment in which electromagnetic radiation is emitted and sensed. While it may be desired to maximize airflow between the interior of the smoke chamber and an exterior environment, performance of the hazard detector may degrade if a pressure differential exists across the hazard detector. That is, if the hazard detector is mounted in a location that provides higher pressure on one side (e.g., a side that is not necessarily to be monitored) it may be possible for air in the higher pressure area to push away the air that is to be monitored.

SUMMARY

In an embodiment, an electrical connector for a hazard detector includes a socket body that includes four lateral walls, a rear wall, a catch feature and a catch support. Each of the four lateral walls adjoins two others of the lateral walls, and the rear wall, continuously and airtightly along edges thereof. The catch support continuously adjoins two of the lateral walls along edges of the catch support to asymmetrically define a catch cavity and a plug cavity on opposing sides of the catch support, a first side of the rear wall facing the plug cavity and a second, counterfacing side of the rear wall bounding a rear surface of the socket body. The catch feature couples with the catch support within the catch cavity. A plurality of electrical pins passes through the rear wall of the socket body such that one end of each of the electrical pins is disposed within the plug cavity, and an opposing end of each of the electrical pins extends away from the rear surface of the socket body.

In an embodiment, a hazard detector includes an enclosure that defines an aperture, and a socket that receives electrical power for operating the hazard detector. The socket includes a socket body having four lateral walls and a rear wall, each of the four lateral walls adjoining two others of the lateral walls, and the rear wall, continuously and airtightly along edges thereof, forming a plug cavity. The socket body forms a mounting flange along edges of the lateral walls that are furthest from the rear wall. The socket further includes a plurality of electrical pins that pass through the rear wall of the socket body, such that first ends of each of the electrical pins are disposed within the plug cavity, and opposing ends of each of the electrical pins extend away from a rear surface of the socket body. The socket is coupled with the enclosure such that the mounting flange forms an airtight seal with the enclosure about a periphery of the aperture.

BRIEF DESCRIPTION OF THE DRAWINGS

A further understanding of the nature and advantages of various embodiments may be realized by reference to the following figures. In the appended figures, similar components or features may have the same reference label. Further, various specific components may be distinguished by a reference label followed by a dash and a second label that distinguishes among the similar components (e.g., electrical pins 325-1, 325-2). If only the first reference label is used in the specification (e.g., electrical pins 325), the description is applicable to any one of the similar components having the same first reference label irrespective of the second reference label.

FIGS. 8A and 8B are isometric and top plan views respectively of a sealing plug, showing a plurality of sealing features that engage surfaces of a molding aperture to form an airtight seal of the connector socket of FIG. 3, in accord with an embodiment.

DETAILED DESCRIPTION

Figure 1A:
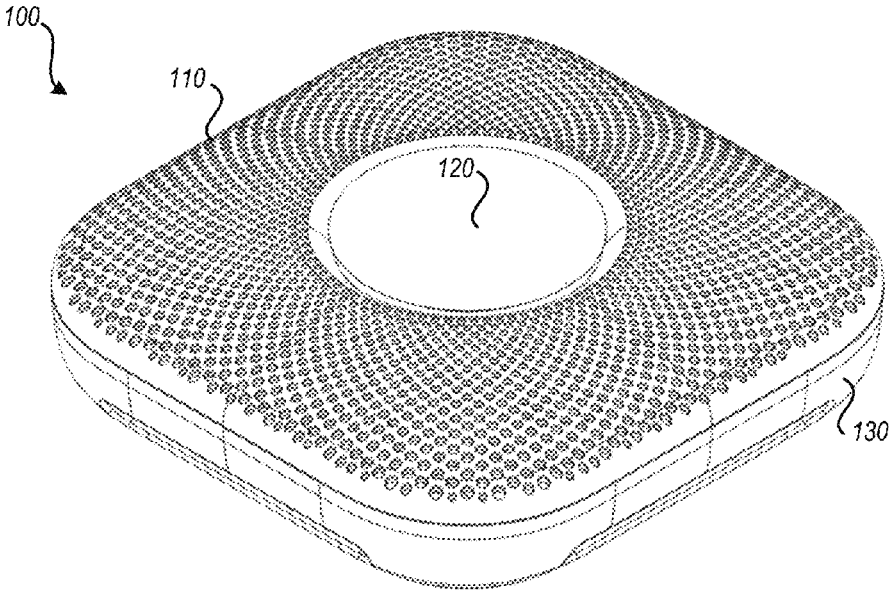
FIGS. 1A and 1B illustrate an embodiment of a smart combined smoke detector and carbon monoxide device.

Aesthetics and ease of operation—which may be collectively thought of as contributing to "user experience"—drive consumer acceptance and marketability of many devices that may be installed in homes. Hazard detectors, such as for example smoke or carbon monoxide alarms, are no exceptions to this. Not all present day hazard detectors maintain a good user experience while meeting the utilitarian (e.g., safety driven) specifications demanded of them. The present disclosure provides embodiments of electrical connectors for use in hazard detectors, that meet such specifications while providing a high level of user experience. It is to be appreciated that, as used herein, the term user(s) may refer, without limitation, to one or more of customer(s), installer(s), homeowner(s), occupant(s), guest(s), tenant(s), landlord(s), repair person(s), according to the context of the interaction described.

For overall understanding, a big picture view of an embodiment of a hazard detector is first described. Such a device may be a dedicated smoke detector or a combination device, such as a combined carbon monoxide and smoke detector. FIG. 1 illustrates an embodiment of a hazard detector 100, in the form of a smart combined smoke and carbon monoxide detector. Hazard detector 100 may be suitable for mounting to a wall or ceiling in a room (or other location) within a structure in which smoke and/or carbon monoxide is to be monitored. Hazard detector 100 may be a "smart device," meaning hazard detector 100 can communicate, likely wirelessly, with one or more other devices or networks. For instance, hazard detector 100 may communicate with a remote server via the Internet through any of a variety of different communication schemes including, but not limited to, a combination of a home network and Internet Service Provider (ISP), a wired or wireless telephone network, a 3G/4G or greater wireless data communications network, and so forth. The hazard detector 100 may further communicate with any of a variety of other smart-home devices using any of a variety of communications including, but not limited to, a home wireless network, such as an IEEE 802.11a/b/g network, a standard or proprietary low-power mesh communications network (e.g., 802.15.4-based networks, Zigbee®, Z-wave®, Thread™, etc.), home wired networks (e.g., CATS/6 Ethernet), home powerline networks (e.g., Homeplug), and so forth, including any of a variety of hybrid combinations thereof. A smart device may allow a user to interact with the device via wireless communication, either via a direct or network connection between a computerized device (e.g., smart watch, cellular phone, tablet computer, laptop computer, desktop computer, etc.) and the smart device. One particularly advantageous context includes embodiments in which the hazard detector 100 achieves data communications via a home powerline connection, with increased data capacity being fostered by a dependable, clean, reliable AC power connection to hazard detector 100.

FIG. 1A illustrates an angular top projection view of hazard detector 100. Hazard detector 100 may generally be square or rectangular and have rounded corners. Visible in the angular top projection view are various components of hazard detector 100, including: an aesthetically pleasing cover grille 110, lens/button 120, and enclosure 130. Cover grille 110 may serve to allow air to enter hazard detector 100 through many holes, giving hazard detector 100 an aesthetically pleasing appearance. Cover grille 110 may further serve to allow light to pass into the external environment of hazard detector 100 from internal light sources (e.g., indicator LEDs). Light may be routed internally to cover grille 110 by a light pipe (230, noted in relation to FIG. 2A). It should be understood that the arrangement of holes and shape of cover grille 110 may vary by embodiment. Lens/button 120 may serve multiple purposes. First, lens/button 120 may function as a lens, such as a Fresnel lens, for use by a sensor, such as an infrared (IR) sensor, located within hazard detector 100 behind lens/button 120 for viewing the external environment of hazard detector 100. Additionally, lens/button 120 may be actuated by a user by pushing lens/button 120. Such actuation may serve as user input to hazard detector 100. Enclosure 130 may serve as a housing for at least some of the components of hazard detector 100.

Figure 1B:
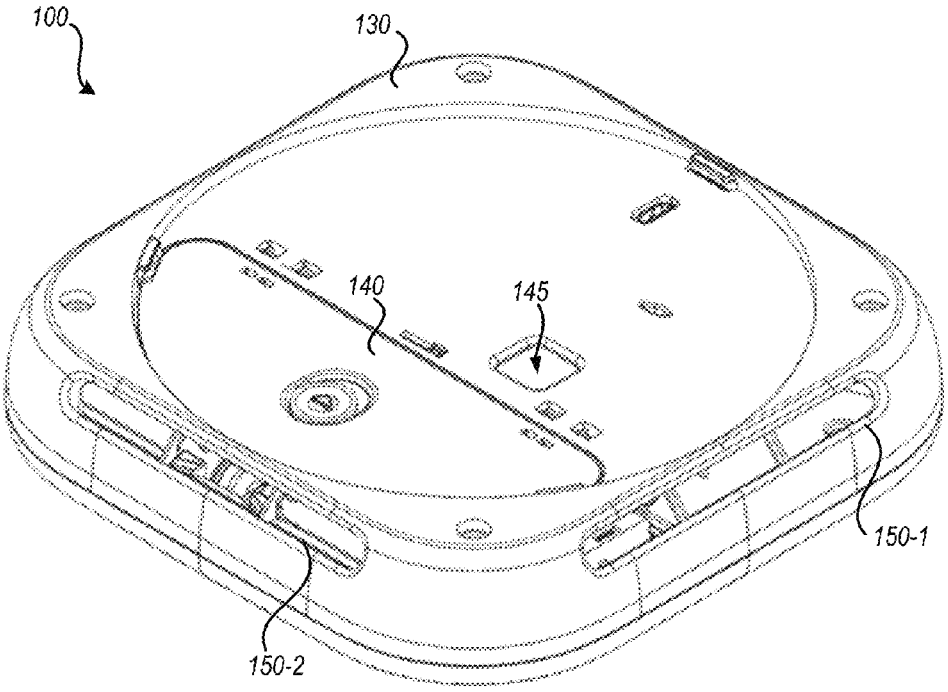

FIG. 1B illustrates an angular bottom projection view of hazard detector 100. Visible in FIG. 1B is a portion of enclosure 130. A battery compartment door 140 is present through which a battery compartment is accessible. Also visible are air flow vents 150-1 and 150-2, which allow air to pass through enclosure 130 and enter a smoke chamber of hazard detector 100, and an aperture 145, for a connector to be described in detail below.

Figure 2A:
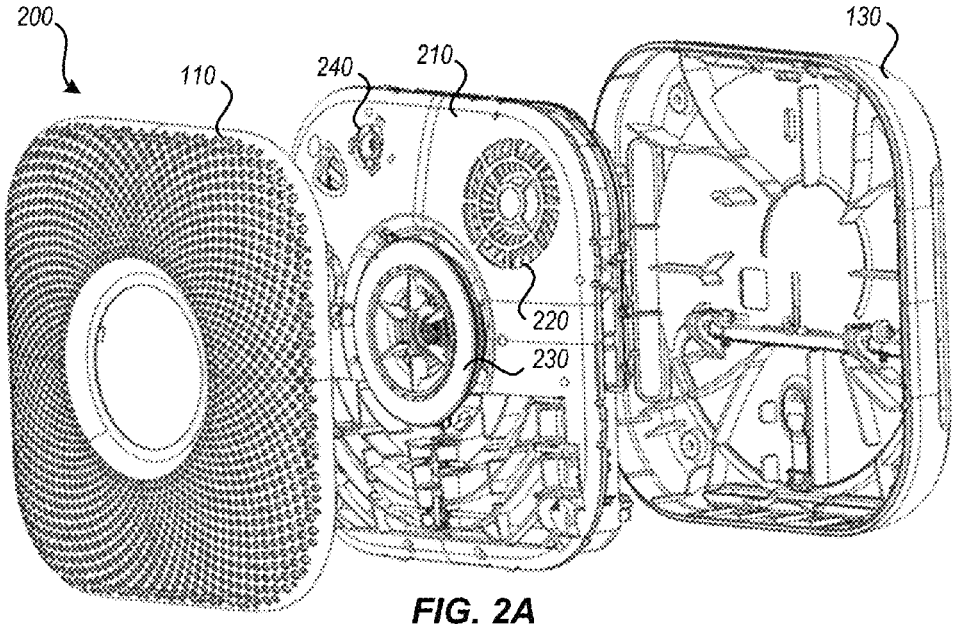
FIGS. 2A, 2B, 2C and 2D illustrate an embodiment of an exploded smart combined smoke detector and carbon monoxide hazard detector.
Figure 2B:
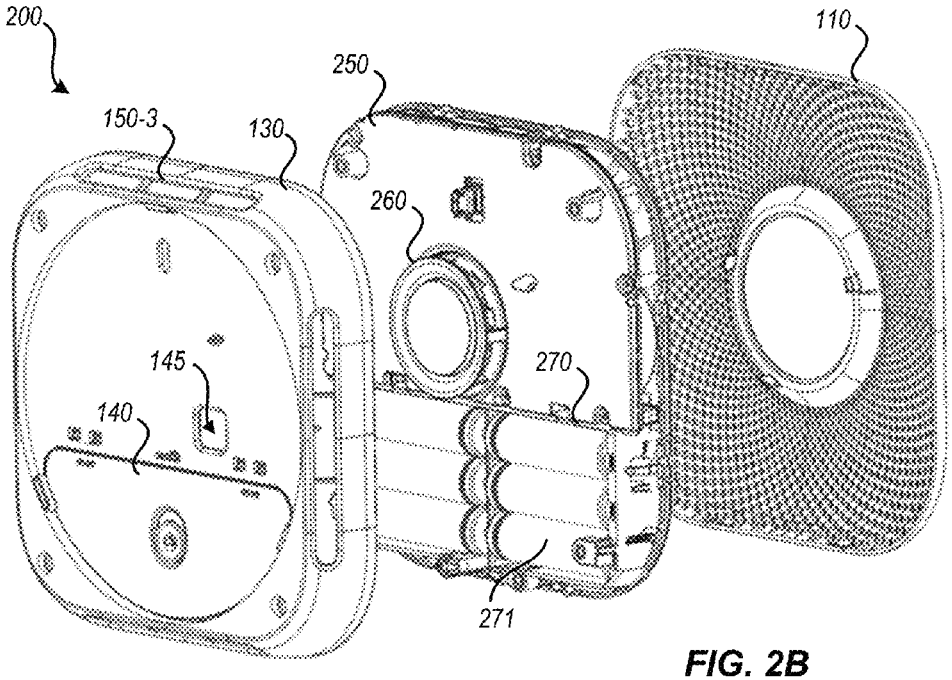
Figure 2C:
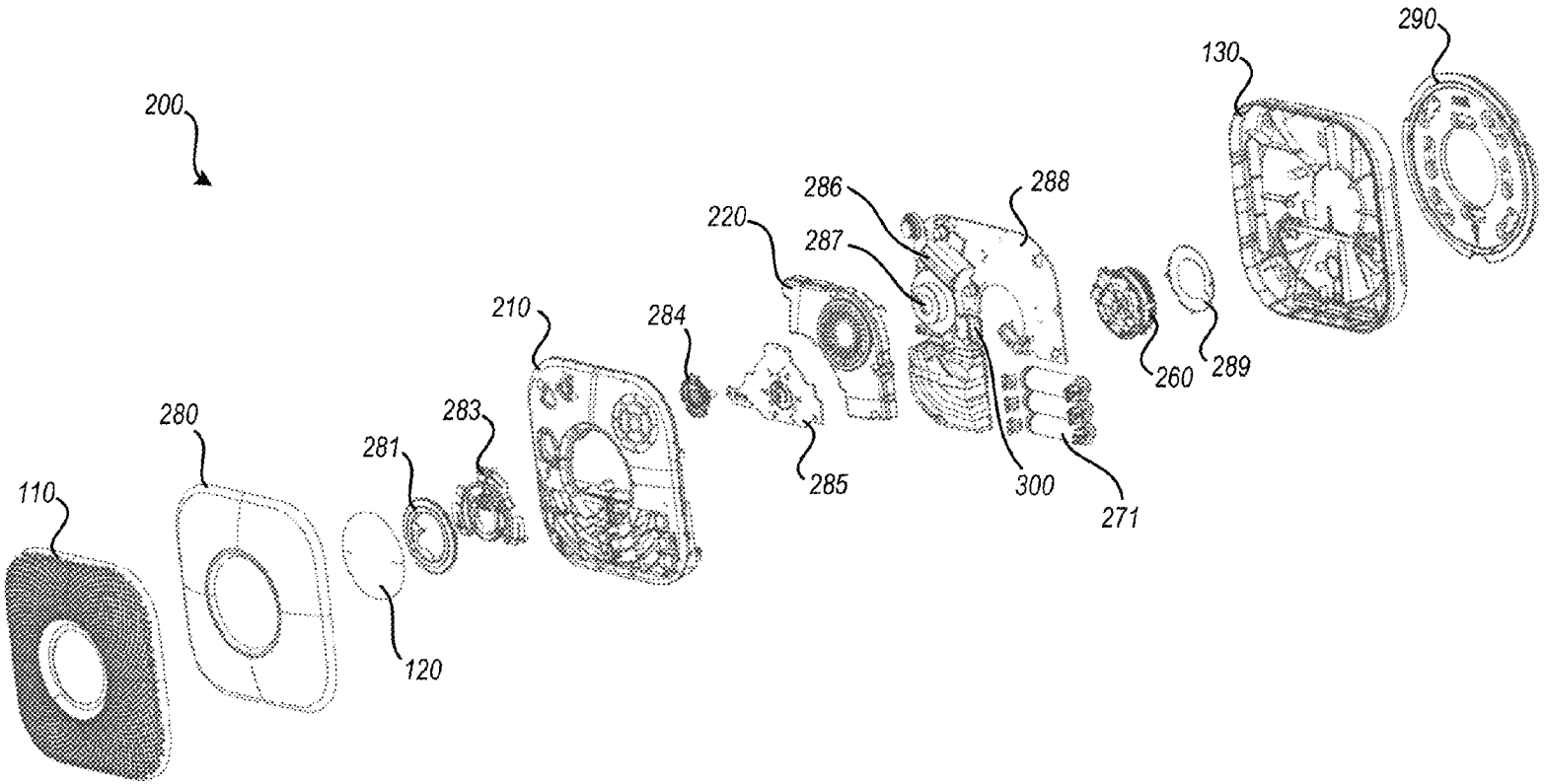

FIGS. 2A, 2B, and 2C are exploded views that illustrate an embodiment of a hazard detector 200, which can be understood as an example of hazard detector 100 of FIGS. 1A and 1B. In FIG. 2A, hazard detector 200 is shown having cover grille 110 and enclosure 130, which together house main chassis 210. Main chassis 210 may house various components that can be present in various embodiments of hazard detector 200, including speaker 220, light pipe 230 and microphone 240. In FIG. 2B, cover grille 110, enclosure 130, air flow vent 150-3 and battery compartment door 140 are visible. Additionally visible is a shield 250 between an underlying printed circuit board (PCB) and enclosure 130. Protruding through shield 250 is smoke chamber 260. A gap may be present between enclosure 130 and shield 250 to allow airflow through air flow vents 150 to have a relatively unobstructed path to enter and exit smoke chamber 260. FIG. 2B also illustrates multiple batteries, installed within a battery compartment 270 of hazard detector 200 and accessible via battery compartment door 140.

FIG. 2C is a more comprehensive exploded view of hazard detector 200. Illustrated in FIG. 2C are cover grille 110, cosmetic mesh 280, lens/button 120, light pipe 281, button flexure 283, chassis 210, gasket 284, passive infrared (PIR) and light emitting diode (LED) daughterboard 285, speaker 220, batteries 271, carbon monoxide (CO) sensor 286, alarm buzzer 287, main circuit board 288, external socket 300 (discussed below), smoke chamber 260, chamber shield 289, enclosure 130 and surface mount plate 290.

Cosmetic mesh 280 sits behind cover grille 110 to obscure external visibility of the underlying components of hazard detector 200, while allowing for airflow through cosmetic mesh 280. Light pipe 281 serves to direct light generated by lights (e.g., LEDs such as the LEDs present on daughterboard 285) to the external environment of device 200C by reflecting off of a portion of cover grille 110. Button flexure 283 serves to allow a near-constant pressure to be placed by a user on various locations on lens/button 120 to cause actuation. Button flexure 283 may cause an actuation sensor located off-center from lens/button 120 to actuate in response to user-induced pressure on lens/button 120. Daughterboard 285 may have multiple lights (e.g., LEDs) and a PIR sensor (or other form of sensor). Daughterboard 285 may be in communication with components located on main circuit board 288. The PIR or other form of sensor on daughterboard 285 may sense the external environment of hazard detector 200 through lens/button 120. Gasket 284 may at least partially house microphone 240 (FIG. 2B) and help to isolate the PIR sensor on daughterboard 285 from dust, bugs and the like that may affect performance of hazard detector 200.

Alarm buzzer 287, which may be activated to make noise in case of an emergency (and when testing emergency functionality), and carbon monoxide sensor 286 may be located on main circuit board 288. Main circuit board 288 may interface with one or more batteries 271, which serve as either a primary source of power for the device, or as a backup source of power if another source, such as power received via socket 300, is unavailable. Protruding through main circuit board and shield 250 (FIG. 2B) may be smoke chamber 260, such that air (including smoke, if present in the external environment) passing between shield 250 and enclosure 130 is likely to enter smoke chamber 260. Smoke chamber 260 may be capped by chamber shield 289, which may be conductive (e.g., metallic). Smoke chamber 260 may be encircled by a conductive (e.g., metallic) mesh (not pictured). Enclosure 130 may be attached and detached from surface mount plate 290. Surface mount plate 290 may be configured to be attached via one or more attachment mechanisms (e.g., screws or nails) to a surface, such as a wall or ceiling, to remain in a fixed position. Enclosure 130 may be attached to surface mount plate 290 and rotated to a desired orientation (e.g., for aesthetic reasons). For instance enclosure 130 may be rotated such that a side of enclosure 130 is parallel to an edge of where a wall meets the ceiling in the room in which hazard detector 200 is installed.

Figure 2D:
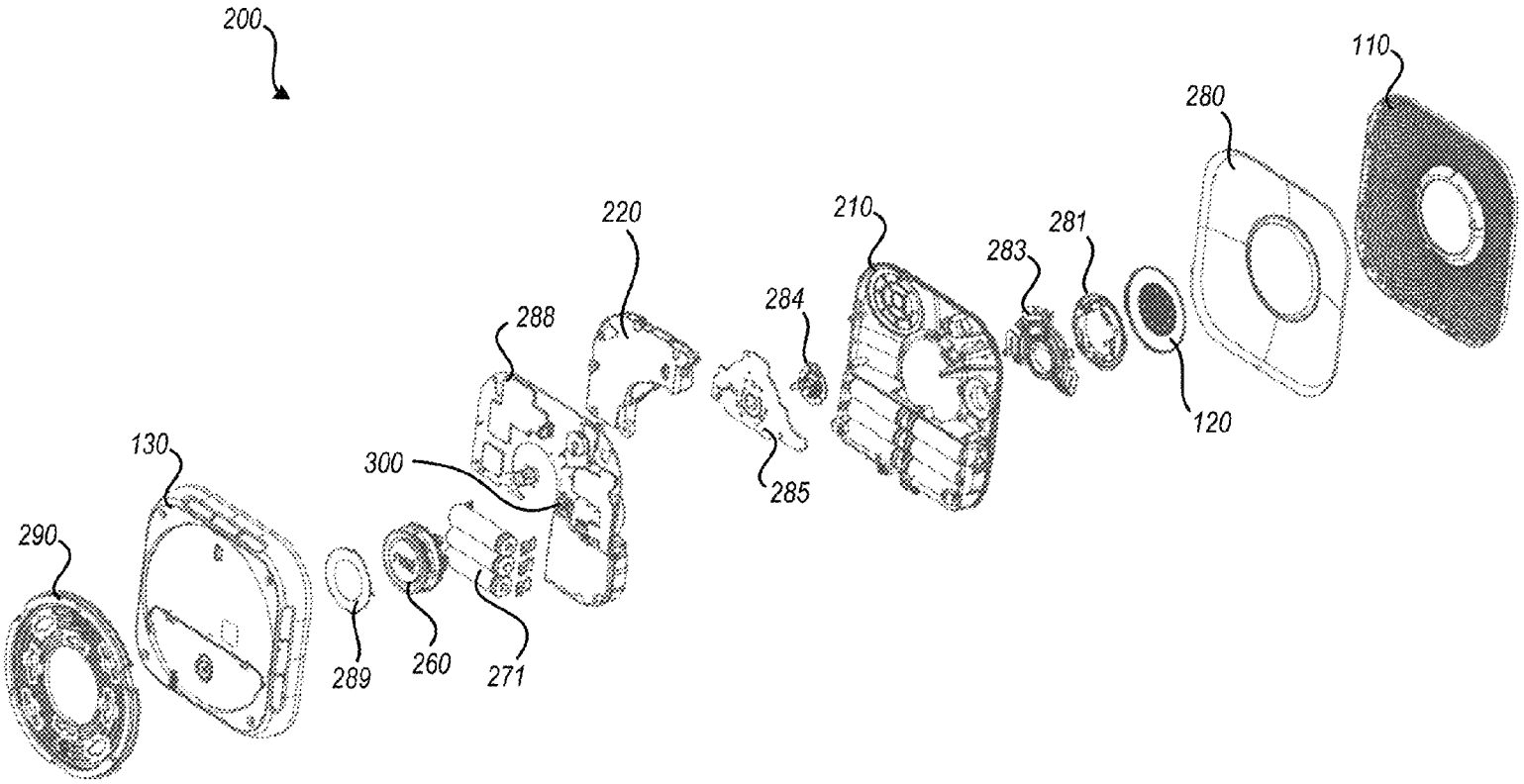

FIG. 2D is an exploded view of hazard detector 200 viewed from a reverse angle as compared with the view of FIG. 2C. Shown in the FIG. 2D view of hazard detector 200 are cover grille 110, cosmetic mesh 280, lens/button 120, light pipe 281, button flexure 283, main chassis 210, gasket 284, passive infrared (PIR) and light emitting diode (LED) daughterboard 285, batteries 271, speaker 220, main circuit board 288, socket 300, smoke chamber 260, chamber shield 289, enclosure 130, and surface mount plate 290. It should be understood that alternate embodiments of hazard detector 200 may include more, fewer or different components than illustrated in FIGS. 2A, 2B, 2C and/or 2D.

An external power connector for hazard detector 100 or 200, that is configured for easy user manipulation and atmospheric isolation, is now described. FIGS. 3, 4A, 4B, 5A, 5B, 6A and 6B illustrate features of an embodiment of the connector socket, its mating plug and its emplacement in a hazard detector. These features are listed first, followed by a discussion of innovative features of the connector socket and plug, and their integration within a hazard detector. It should be understood that although the connector described below is designed as an alternating-current (AC) connector, the construction and operational principles would apply equally to a connector for direct-current (DC) external power.

Figure 3:
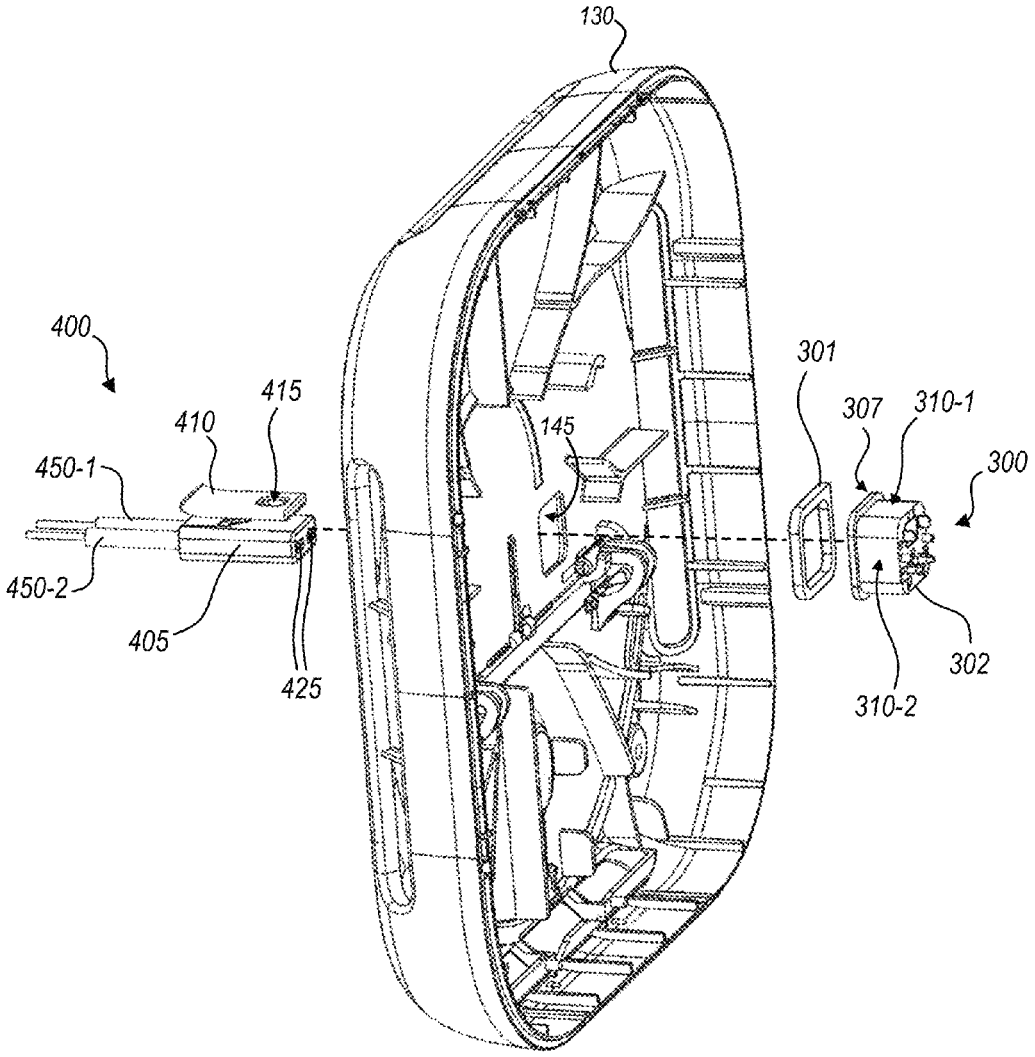
FIG. 3 shows an exploded isometric view of certain components of the hazard detectors of FIGS. 1A, 1B, 2A, 2B, 2C and/or 2D, including a connector socket and a connector plug, in accord with an embodiment.

FIG. 3 shows an exploded isometric view of certain components of hazard detector 100 or 200. Illustrated within FIG. 3 are an interior surface of enclosure 130, along with a connector socket 300 and a connector plug 400 that supply power to the hazard detector. Features of connector socket 300 that are labeled in FIG. 3 include a socket body 302 that includes a mounting flange 307, a top wall 310-1 and a side wall 310-2. Top wall 310-1, side wall 310-2, and a further side wall 310-3 and bottom wall 310-4 (see FIG. 4B) are also collectively referred to as lateral walls 310 herein. FIG. 3 also shows that top wall 310-1 transitions into side wall 310-2 along a curved profile and that mounting flange 307 features rounded corners. When assembled, socket body 302 presses against an optional gasket 301 located between mounting flange 307 and the interior surface of enclosure 130, with plug and catch cavities (discussed below) of socket body 302 facing aperture 145. Gasket 301 may not be present in all cases, e.g., mounting flange 307 and the internal surface of enclosure 130 may be manufactured to tolerances that provide an airtight fit without gasket 301, may include interlocking features that provide the airtight fit, and/or mounting flange 307 may be press-fit into aperture 145. Features of connector plug 400 that are visible in FIG. 3 include plug body 405, latch member 410 defining latch aperture 415, pin sockets 425, and wires 450-1, 450-2.

Figure 4A:
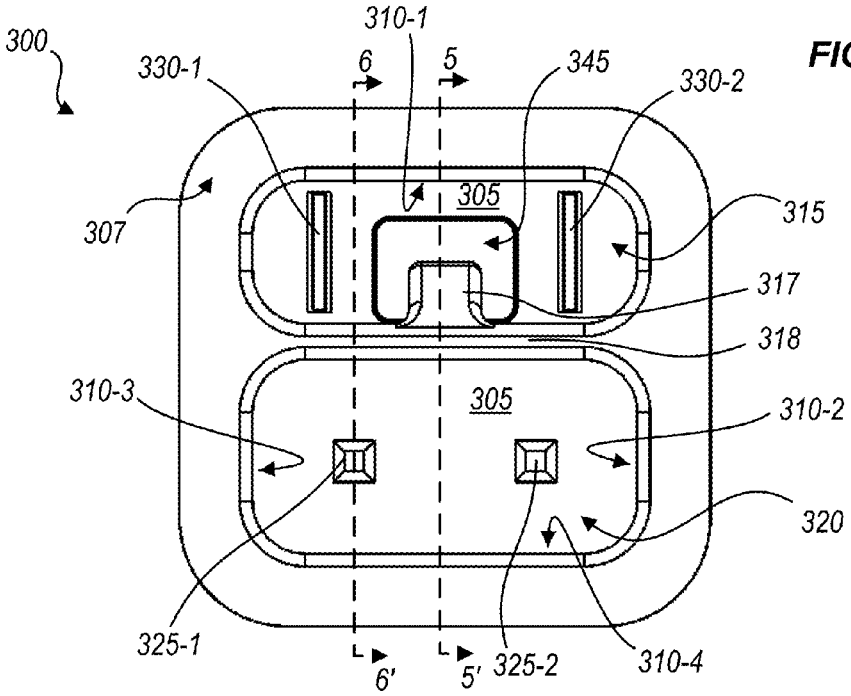
FIGS. 4A and 4B show front and rear elevations, respectively, of the connector socket of FIG. 3, in accord with an embodiment.
Figure 4B:
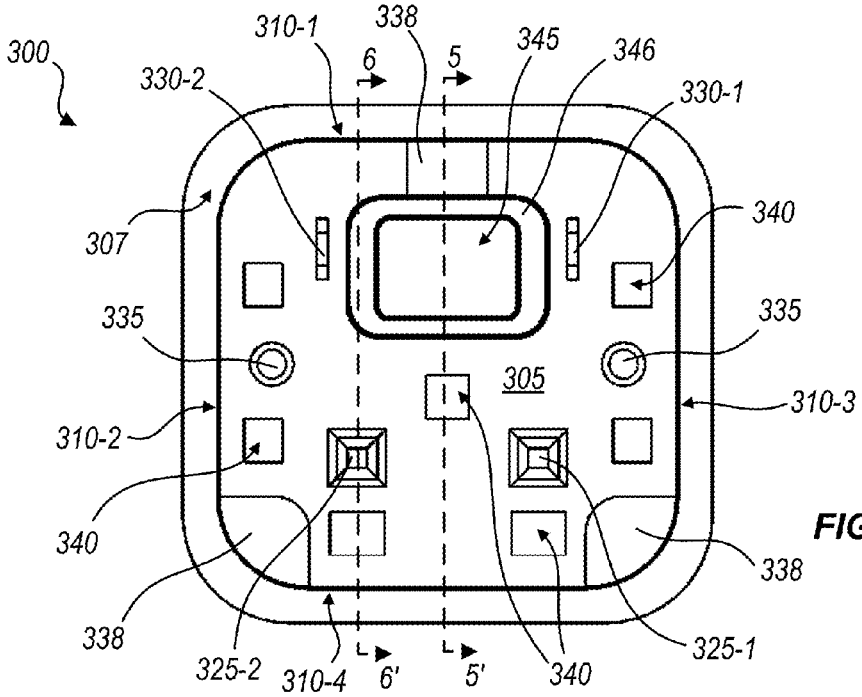

FIGS. 4A and 4B show front and rear elevations, respectively, of connector socket 300. FIG. 4A shows mounting flange 307, positions of interior surfaces of top wall 310-1, side walls 310-2 and 310-3 and bottom wall 310-4, a catch cavity 315 and a plug cavity 320 defined by lateral walls 310 and a catch support 318 between the cavities, a catch feature 317 coupled with catch support 318, electrical pins 325-1, 325-2, interior surfaces of stabilizing prongs 330-1, 330-2 and molding aperture 345 within rear wall 305. Like FIG. 3, FIG. 4A shows that all four lateral walls 310 of socket body 302 transition into one another along curved profiles, and that mounting flange 307 features rounded corners. Similarly, catch support 318 transitions into mounting flange 307 and lateral walls 310-2 and 310-3 along rounded profiles. The rounded transitions of lateral walls 310 to one another, and of catch support 318 to lateral walls 310-2 and 310-3 add mechanical strength to socket body 302 for high dimensional stability under physical stress. For this reason, such transitions may have radii of curvature that are greater than or equal to thicknesses of the lateral walls 310. Catch support 318 also asymmetrically divides a cavity formed by the four lateral walls 310, such that plug 400 can only fit into socket 300 in one orientation, as discussed further below. Lateral walls 310, rear wall 305, catch support 318, catch feature 317 and assembly keys 335 are advantageously molded integrally to form socket body 302, although in embodiments socket body 302 may encapsulate metal members as stiffeners. In embodiments, stabilizing prongs 330, electrical pins 325 are formed of phosphor bronze, and are press-fit into socket body 302 after molding. Assembly keys 335 are used, in embodiments, to align socket 300 with a circuit board.

FIG. 4B shows rear wall 305, mounting flange 307, positions of top wall 310-1, lateral walls 310-2 and 310-3 and bottom wall 310-4, electrical pins 325-1, 325-2, stabilizing prongs 330-1, 330-2, assembly keys 335, standoff features 338, molding voids 340 and molding aperture 345 within rear wall 305. Molding aperture 345 penetrates rear wall 305 only in the area shown in FIG. 4A; in the rear view of FIG. 4B, an inner shelf 346 can be seen Inner shelf 346 assists in maintaining an airtight seal formed by socket 300 by helping a sealing plug (shown in FIGS. 5A, 5B, 6A, 6B) resist moving toward or into catch cavity 315 when positive pressure exists at a rear side of rear wall 305. Standoff features 338 are located about edges of rear wall 305 and extend rearward by a small amount (e.g., about 0.2 mm) from the rest of rear wall 305.

Standoff features 338 create a plane that contacts a PCB that socket 300 couples with (see FIG. 7) to ensure that mounting flange 307 is parallel with the PCB. Also, the height of standoff features 338 is sufficient to allow an appropriately sized solder fillet to form when electrical pins 325-1, 325-2 are soldered to the PCB.

Stabilizing prongs 330 are T-shaped (as seen by comparing FIG. 4A with FIG. 4B) such that a portion of each stabilizing prong 330 that is press-fitted into a front side of rear wall 305 (e.g., inserted through catch cavity 315) is wider than a portion that protrudes from rear wall 305. Also, it should be noted that for mechanical strength, stabilizing prongs 330 are fitted into the thicker portion of rear wall 305 discussed above. A first end (e.g., the crossbar of the T) of each stabilizing prong is approximately coplanar with a front surface of rear wall 305, and a second end of each stabilizing prong protrudes from rear wall 305. Once the portions of stabilizing prongs 330 that protrude from rear wall 305 are soldered to a PCB, the T shape of stabilizing prongs 330 disposed within the thicker portion of rear wall 305 provides extra ruggedness with respect to lateral forces, such as would be imparted by pulling on wires 450 of plug 400, while plug 400 is latched into socket 300. That is, instead of such lateral forces being undesirably transmitted solely to electrical pins 325, such forces are largely transmitted to stabilizing prongs 330. Side-to-side lateral forces would be opposed by the two prongs acting together (one would resist the applied tensile stress while the other would resist the applied compressive stress). Up-and-down lateral forces would be opposed by the T-shapes of the prongs compressing against the material of the socket, as well as by acting in concert with the electrical pins. Upon reading and comprehending the present disclosure, one skilled in the art will be able to adapt the principles discussed above to implement similar ways of stabilizing a socket, such as use of a single stabilizing prong, use of more than two stabilizing prongs, and/or use of stabilizing prongs having more complex shapes.

Like FIG. 3, FIGS. 4A and 4B show that all four walls 310 of socket body 302 transition into one another along curved profiles and that mounting flange 307 features rounded corners; similarly, catch support 318 transitions into mounting flange 307 and lateral walls 310-2 and 310-3 along curved profiles. In both FIGS. 4A and 4B, lines 5-5' and 6-6' indicate cross-sectional planes illustrated in FIGS. 5A and 5B, and FIGS. 6A and 6B, respectively.

Figure 5A:
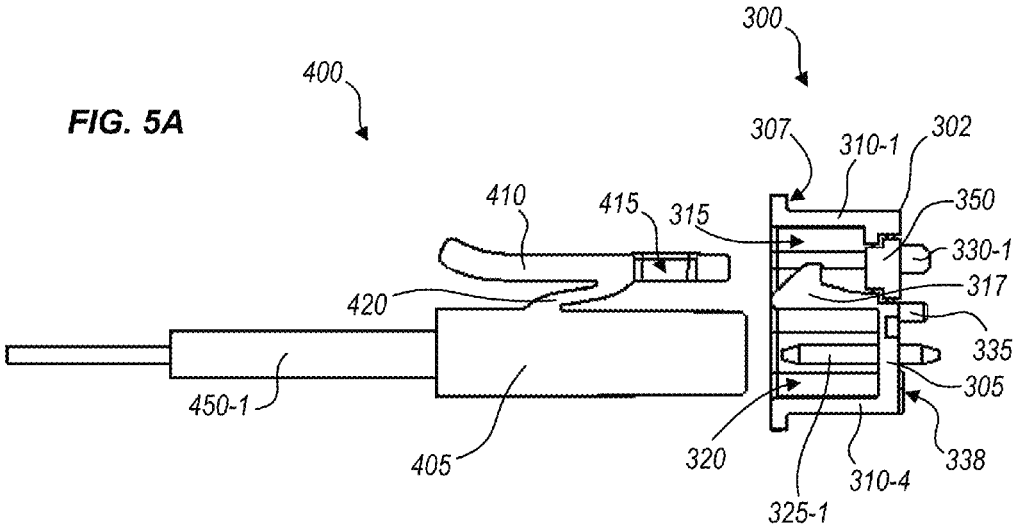
FIGS. 5A and 5B show cutaway views of the connector socket and connector plug of FIG. 3 taken along line 5-5', FIGS. 4A and 4B, in accord with an embodiment.
Figure 5B:
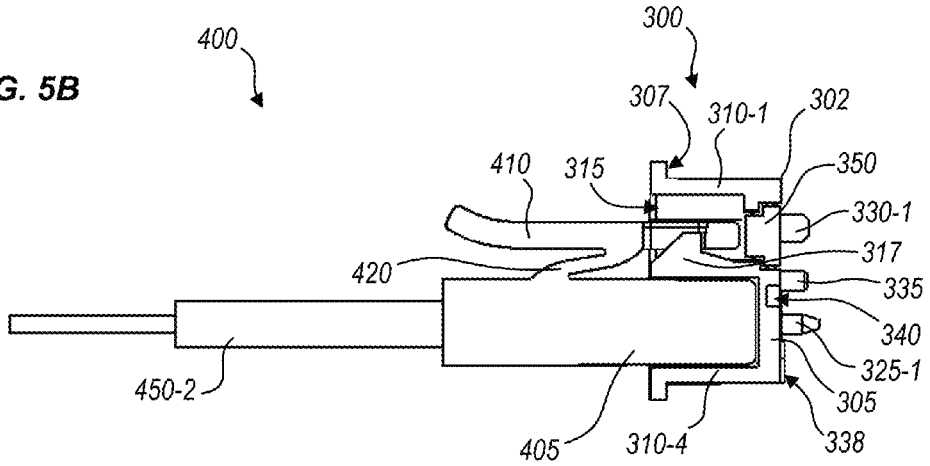

FIGS. 5A and 5B are cutaway illustrations of connector socket 300 and connector plug 400 taken along line 5-5' shown in FIGS. 4A and 4B. Both FIGS. 5A and 5B show connector socket 300 with socket body 302, including rear wall 305, mounting flange 307, top wall 310-1, bottom wall 310-4, catch feature 317 and standoff feature 338. A sealing plug 350 is seated against shelf 346 within a molding aperture 345 defined in rear wall 305 (see FIGS. 4A, 4B and FIG. 8). As shown in FIGS. 5A and 5B, rear wall 305 is thicker where it is adjacent to catch cavity 315 than where it is adjacent to plug cavity 320. The increased thickness of rear wall 305 adjacent to catch cavity 315 provides improved ruggedness for transmitting mechanical loads to stabilizing prongs 330, as discussed below, enables formation of shelf 346 (FIG. 4B) for sealing plug 350 to seat against, and increases the cross-sectional area available for sealing surfaces of plug 350 to seal against, to maintain airtightness.

Both FIGS. 5A and 5B also show connector plug 400 with plug body 405, latch member 410, latch aperture 415 defined within latch member 410, and latch spring 420. Plug body 405 is advantageously molded integrally with latch spring 420 and latch member 410. In embodiments, plug 400 may encapsulate metal members as stiffeners. It can be seen in FIGS. 5A and 5B that plug body 405 is sized to fit within plug cavity 320, but not within catch cavity 315, such that plug 400 cannot be inserted into socket 300 upside down. (Similarly, once socket 300 is mounted within hazard detector 100, 200, plug body 405 also cannot be inserted upside down into plug cavity 320, because latch member 410 will run up against enclosure 130; see FIG. 3). FIG. 5A shows connector plug 400 positioned for insertion into connector socket 300, while FIG. 5B shows connector plug 400 inserted into connector socket 300, with latch member 410 engaged with catch feature 317. Latch aperture 415 is sized to accommodate catch feature 317; that is, when latch member 410 engages with catch feature 317, latch aperture 415 fits about catch feature 317 but does not permit significant movement of latch member 410 (and thus plug 400) with respect to socket 300 in the direction of insertion and withdrawal.

Figure 6A:
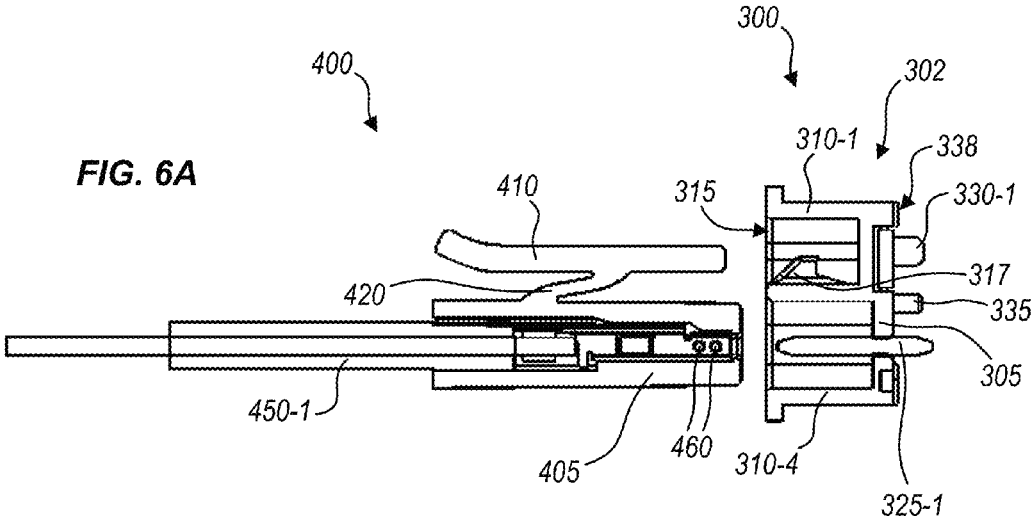
FIGS. 6A and 6B show cutaway views of the connector socket and connector plug of FIG. 3 taken along line 6-6', FIGS. 4A and 4B, in accord with an embodiment.
Figure 6B:
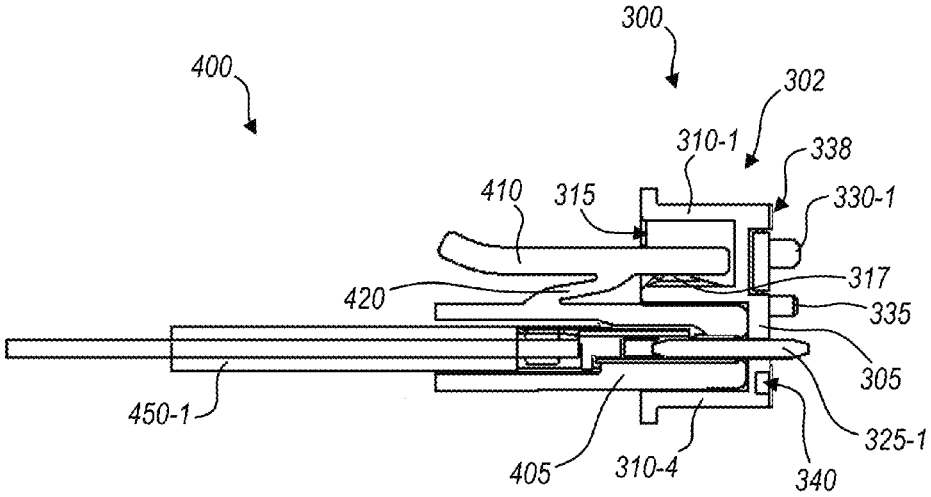

FIGS. 6A and 6B are cutaway illustrations of connector socket 300 and connector plug 400 taken along line 6-6', FIGS. 4A and 4B. Both FIGS. 6A and 6B show connector socket 300 with socket body 302 including rear wall 305, mounting flange 307, top wall 310-1, bottom wall 310-4 and standoff feature 338. Sealing plug 350 is seated within molding aperture 345 defined in rear wall 305 (see FIGS. 4A, 4B); molding aperture 345 does not completely penetrate rear wall 305 in the cross-sectional plane of FIGS. 6A and 6B (see FIG. 4B). Electrical pin 325-1 extends through rear wall 305. As shown in FIGS. 6A and 6B, rear wall 305 is thicker where it is adjacent to catch cavity 315 than where it is adjacent to plug cavity 320, for improved dimensional stability. Both FIGS. 6A and 6B also show connector plug 400 with plug body 405, latch member 410, pin socket 425-1 and wire 450-1. FIG. 6A shows contact features 460 that scrub against electrical pins when plug 400 is inserted into socket 300; contact features 460 are hidden behind electrical pin 325-1 in the view of FIG. 6B. FIG. 6A shows connector plug 400 positioned for insertion into connector socket 300, while FIG. 6B shows connector plug 400 inserted into connector socket 300, with electrical pin 325-1 engaged with pin socket 425-1.

Socket 300 and plug 400 are jointly optimized to provide easy user manipulation and tactile feedback for a high level of user experience, while meeting a variety of electrical and mechanical specifications. Exemplary requirements that are jointly met or exceeded by embodiments such as socket 300 and plug 400 are provided in the following table. Some of the listed requirements are based specifications such as Underwriters' Laboratories (UL) 217 sections 17.4, 41, 71, UL 268 section 11.4, UL 521 section 48, UL 2034 section 67.3, Appliance Wiring Materials (AWM) 3386 and Electronics Industry Alliance (EIA) 364, and others are based on requirements to provide good user experience.

TABLE 1

Specifications for hazard detector connector/plug system

| Item | Requirement | Basis for requirement |
|---|---|---|
| Electrical voltage rating | 300 V AC | Max 240 VAC (EU) |
| Insulation Resistance | 1000 MOhms min after 1 minute at 500 VDC | EIA 364 |
| Dielectric Withstanding Voltage | 500 VAC for 1 minute at sea level | EIA 364 |
| Maximum socket temperature | >260 C. | Survive heat of soldering or reflow |
| Insertion force | <15N | User experience |
| Feedback upon engaging plug with socket | Tactile and audible "click" | User experience |
| Retention force | >44.5N | UL 217, UL 568 |
| Electrical connection stability | <10 mOhm change in resistance with 50N side-load applied to wire harness (mated pair) | EIA 364 |
| Disassembly forces | Can be applied to plug only for one hand operation | User experience |
| Withdrawal force, unlatched | <15N | User experience |
| Atmospheric isolation | <1% change in per-foot obscuration within hazard detector sensitivity with 0.015 in H20 back-pressure | UL 217 section 41 |

In some cases, prior art connectors for hazard detectors meet the retention force and atmospheric isolation requirements of Table 1 by providing a plug that would fit tightly within a corresponding socket, and would not necessarily latch into place. In some such cases, sockets were sometimes constructed as frames, instead of closed-end boxes, so the sockets would not necessarily be airtight. However, the plug would be airtight, and would form a seal to the socket about its periphery to complete a largely airtight seal of the socket. Such arrangements did not always provide a good user experience, as they involved high insertion forces to achieve the tight fit, and did not necessarily provide tactile or audible feedback when the plug was fully seated. Further, such connectors did not necessarily meet the dimensional stability requirement of Table 1, because pulling on the plug and/or wires could cause the socket frame to distort. Still further, the ability of such connectors to meet the retention force specification is not always guaranteed, as the force with which the plug is put into the socket by the user—which can vary, depending on the user and other circumstances—may determine the retention force. And, the withdrawal force would be quite high, as it would have to exceed the retention force. In other cases, a plug would simply couple with pins on a circuit board, with foam filling gaps between the plug and the area around the pins to provide a seal; often such arrangements would require coupling two latches against an opposing force of the foam, to maintain the seal by ensuring immobility of the plug. Arrangements of this type tend to provide poor user experience by requiring careful user alignment of the plug with the pins and requiring operation of two latches while holding a plug firmly in place. Also, such arrangements typically resulted in larger physical volume of the connector arrangement, because the latching features of the plug and housing mechanically couple across three or more physical components, each component having its own mechanical tolerances. For example, the plug would include one of the latch or catch features; the plug would mate with pins on a PCB, but the PCB would couple with at least a housing that would include the other of the latch/catch features. Consequently, the volume of the connector arrangement had to be larger than otherwise required, to accommodate the tolerance stackup of the latch and catch features.

Socket 300 and plug 400 meet all of the requirements shown in Table 1 through one or more combinations of the innovative features described above and as follows. In a first example of meeting specifications while providing a good user experience, socket 300 is not provided as a frame, but as socket body 302, including rear wall 305, mounting flange 307, the four walls 310-1 through 310-4, and catch support 318. When sealing plug 350 is seated within molding aperture 345, socket 300 is airtight, and when mounted with an appropriate gasket against aperture 145 of hazard detector 200, forms an airtight plug to seal a back wall of hazard detector 200. Also, as noted in connection with FIGS. 5A and 5B, rear wall 305 is thicker where it is adjacent to catch cavity 315 than where it is adjacent to plug cavity 320. The full "five-sided box" construction of socket body 302 (e.g., rear wall 305 and four lateral walls 310), mounting flange 307, catch support 318, stabilizing prongs 330-1, 330-2, the extra thickness of rear wall 305 adjacent to catch cavity 315 and all of the rounded corners where these features adjoin, render socket 300 mechanically strong so as to meet the dimensional stability requirement of Table 1. The "five-sided box" construction also renders the socket itself airtight, except for the possibility of a molding aperture and a sealing plug, as shown in FIGS. 4A, 4B, 5A, 5B, 6A and 6B, discussed below.

In another example of meeting specifications while providing a good user experience, socket 300 and plug 400 implement a latching system that decouples insertion, retention and withdrawal forces, while also providing tactile and audible feedback as the latch engages. First, the materials utilized to form the major surfaces of socket 300 and plug 400 are made of low friction material. One choice of materials for socket 300 and plug 400 is polyamide 66 nylon, but other plastics may be utilized in embodiments. For example, certain other thermoplastics may also be used, with important criteria including strength, moldability, stability at high temperatures (to withstand heat of soldering) and low friction. With suitable materials, an insertion force required to slide plug 400 into socket 300 is very low until a leading edge of latch member 410 contacts a leading edge of catch feature 317. Further insertion deflects the leading edge of latch member 410 upwards, deforming latch spring 420 and causing an easily felt but not large resistance to further insertion. When plug 400 is inserted such that catch feature 317 is within latch aperture 415, the force built up within latch spring 420 by the deflection snaps latch member 410 back downwards, engaging latch member 410 with catch feature 317 and providing a very definite, tactile and audible "click."

Once latch member 410 is engaged, plug 400 exhibits a very high retention force within socket 300 (e.g., removal of plug 400 without disengaging latch member 410 would require a force high enough to destroy latch member 410, latch spring 420, catch feature 317 and/or catch support 318). As illustrated, plug 400 and socket 300 significantly exceed the 44.5 N minimum retention force specified in the applicable UL standards (see Table 1 above).

Socket 300 and plug 400 also advantageously decouple withdrawal force from retention force, and support removal of plug 400 from socket 300 as a one-hand operation. To decouple a plug from its associated socket, certain prior art latching arrangements sometimes require a user to grip or manipulate one feature associated with a device or socket thereof, while simultaneously manipulating a second feature associated with the plug. These and/or other prior art plug and socket arrangements sometimes require a high withdrawal force to remove the plug from the socket, due to a tight physical fit required for an airtight fit. Socket 300 and plug 400 elegantly improve the user experience of decoupling by simply requiring a gentle downward press to decouple latch member 410 from catch feature 317, after which plug 400 has very low withdrawal force, and may be removed by the same hand that provides the downward press.

Socket body 302 is advantageously provided as a one piece, molded part; catch feature 317 provides a challenge in this regard, as a mold for socket body 302 must provide mold features in catch cavity 315 between catch feature 317 and rear wall 305. To provide such mold features, molding aperture 345 is defined in rear wall 305 such that a mold assembly for socket body 302 can include a pin that protrudes through and defines molding aperture 345, and provides the required mold feature for catch feature 317. It may be considered unusual to use this type of mold configuration for a socket body, due to the complexity and expense of the mold arrangement. After socket body 302 is molded, sealing plug 350 is installed so as to seat within molding aperture 345. Sealing plug 350 may be formed of silicone for high temperature performance (e.g., to withstand heat of soldering socket 300), and seats within molding aperture 345 to provide atmospheric isolation for a hazard detector (e.g., hazard detector 100, 200). As installed within a hazard detector, sealing plug 350 is surrounded in the forward and backward directions by shelf 346 (FIG. 4B) and by a PCB to which socket 300 is soldered (FIG. 7) such that sealing plug 350 will not be dislodged from molding aperture 345 even if a significant air pressure imbalance were to exist across socket body 302.

Figure 7:
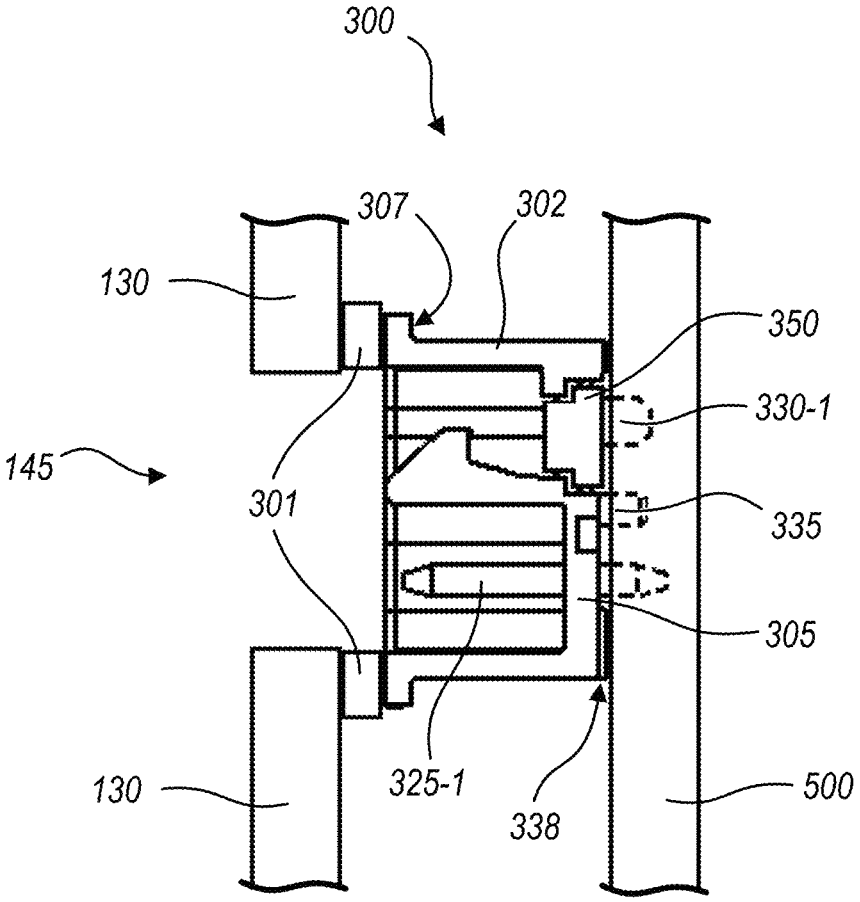
FIG. 7 is a cutaway illustration of the connector socket of FIG. 3 mounted within a hazard detector, in accord with an embodiment.

FIG. 7 is a cutaway illustration of connector socket 300 mounted within a hazard detector, e.g., hazard detector 100 or 200. Stabilizing prongs 330 and electrical pins 325 extend into, and are soldered into, holes in a PCB 500. Assembly keys 335 also extend into corresponding holes in PCB 500 to facilitate assembly. In embodiments, one hole in PCB 500 is typically sized to fit a first assembly key 335 very snugly, a second hole is a slot that, when a second assembly key 335 is inserted, constrains rotation of socket 300 with respect to the first assembly key 335. Holes corresponding to stabilizing prongs and electrical pins 325 have looser tolerances for easy assembly, and provide lateral space for solder fillets to be formed subsequently (e.g., using infrared (IR) or other solder reflow techniques).

PCB 500 couples mechanically with enclosure 130, with optional gasket 301 disposed between mounting flange 307 of socket body 302, and enclosure 130. It will be apparent to one skilled in the art that FIGS. 5A, 5B and 7 provide a further illustration of the advantage of the construction of socket body 302 and its cooperation with plug 400. Latch member 410 of plug 400 mates directly with catch feature 317 that is molded into socket body 302, thus, mechanical tolerances of the latch and socket are much smaller than they would be if a latch/catch feature on a plug was required to mate with a corresponding latch/catch feature that is only indirectly coupled to a the plug when installed. In addition to providing a good user experience, the arrangement shown in FIGS. 5A, 5B and 7 enables the plug/connector combination to be smaller than would be possible if plug 400 did not mate directly with socket body 302.

FIGS. 8A and 8B are isometric and top plan views respectively of sealing plug 350, showing a plurality of sealing features 352 that engage surfaces of molding aperture 345 to form an airtight seal of socket 300 (see FIGS. 4A, 4B, 5A, 5B and 7). When assembled with socket 300, rear face 354 faces rearwardly from socket body 302, front face 356 faces forwardly (e.g., into catch cavity 315, see FIGS. 4A, 4B, 5A, 5B and 7) and intermediate face 358 abuts shelf 346 (see FIG. 4B). The geometry of sealing plug 350 is but one example of providing complementary features of molding aperture 345 in rear wall 305 for sealing plug 350 to provide an airtight seal therewith. One skilled in the art will recognize equivalent, complementary features to provide for a molding aperture and a sealing plug to maintain the airtight seal provided by a socket.

Figure 9A:
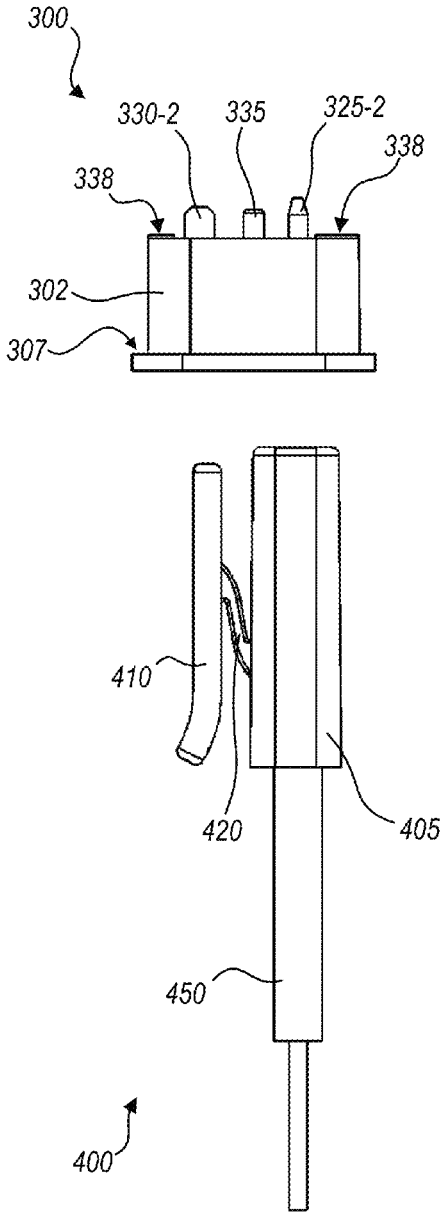
FIGS. 9A and 9B are a side elevation and a top plan view, respectively, of the connector socket and the connector plug of FIG. 3, in accord with an embodiment.
Figure 9B:
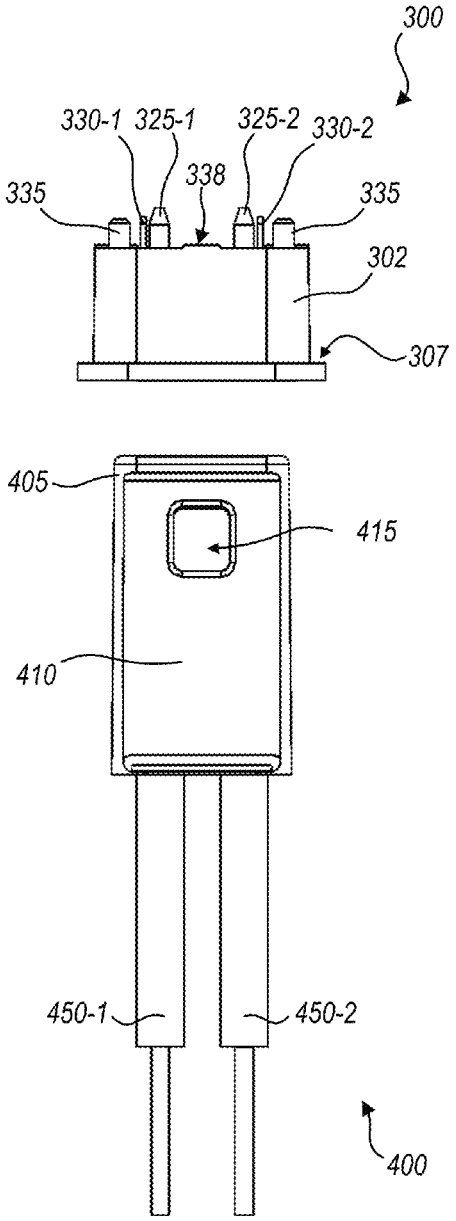

FIGS. 9A and 9B are a side elevation and a top plan view, respectively, of socket 300 and plug 400. Features that are described above and are visible in the views of socket 300 include socket body 302 with molded features such as mounting flange 307, standoff features 338 and assembly keys 335, and installed stabilizing prongs 330 and electrical pins 325. Features that are described above and are visible in the views of plug 400 include plug body 405, latch member 410 with latch aperture 415 therein, latch spring 420 and wires 450.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

What is claimed is:

1. An electrical connector for a hazard detector, the electrical connector comprising:

a socket, comprising:

a socket body that includes four lateral walls, a rear wall, a catch feature and a catch support, each of the four lateral walls adjoining two others of the lateral walls, and the rear wall, continuously and airtightly along edges thereof, the catch support adjoining two of the lateral walls along edges of the catch support to define a catch cavity and a plug cavity on opposing sides of the catch support, a first side of the rear wall facing the plug cavity and a second, counterfacing side of the rear wall bounding a rear surface of the socket body, the catch feature coupling with the catch support within the catch cavity; and a plurality of electrical pins that pass through the rear wall of the socket body such that one end of each of the electrical pins is disposed within the plug cavity, and an opposing end of each of the electrical pins extends away from the rear surface of the socket body; and a plug, comprising:

a plug body that forms a plurality of pin sockets, a plurality of contacts corresponding to the plurality of electrical pins, each of the contacts being disposed within a respective one of the pin sockets, a latch spring that mechanically couples with the plug body, and a latch member that mechanically couples with the latch spring, such that as the plug body inserts into the plug cavity:

the electrical pins disposed within the plug cavity insert into the pin sockets and make contact with the contacts, the latch member inserts into the catch cavity, and the catch feature deflects the latch member.

2. The electrical connector of claim 1, wherein the rear wall of the socket body forms a molding aperture for the catch feature, and further comprising a sealing plug seated within the molding aperture.

3. The electrical connector of claim 1, wherein the socket body is molded of nylon.

4. The electrical connector of claim 1, wherein the rear wall of the socket body has a thickness that is greater in a portion of the rear wall that faces the catch cavity, than in a portion of the rear wall that faces the plug cavity.

5. The electrical connector of claim 1, wherein transitions from ones of the lateral walls to others of the lateral walls and transitions from the catch support to the lateral walls define radii of curvature that are greater than or equal to a thickness of any of the lateral walls.

6. The electrical connector of claim 1, further comprising one or more stabilizing prongs that are press-fit into corresponding apertures within the socket body, such that a first end of each stabilizing prong is approximately coplanar with a front surface of the rear wall, and a second end of each stabilizing prong protrudes from the rear wall.

7. The electrical connector of claim 6, each of the one or more stabilizing prongs comprising a T shape, a crossbar of the T shape being disposed within the rear wall.

8. The electrical connector of claim 1, wherein the plurality of electrical pins, the plurality of pin sockets, a plurality of wires, and the plurality of contacts consist of: two each of the electrical pins, the pin sockets, the wires, and the contacts.

9. The electrical connector of claim 1, wherein the plurality of electrical pins, the plurality of pin sockets, a plurality of wires, and the plurality of contacts comprise three or more each of the electrical pins, the pin sockets, the wires and the contacts, respectively.

10. The electrical connector of claim 1, wherein the plug body, the latch spring and the latch member are molded of nylon.

11. The electrical connector of claim 1, wherein the socket body and the plug cooperate such that an insertion force of the plug into the socket body is less than 15 N.

12. The electrical connector of claim 1, wherein the catch feature deflecting the latch member generates a resistance force of less than 15 N.

13. The electrical connector of claim 1, wherein when the latch member is engaged by the catch feature, the electrical connector provides a retention force of at least 44.5 N, and when the latch member is pressed toward the plug body, the latch member disengages such that the retention force is reduced to less than 15 N.

14. A hazard detector, comprising:

an enclosure that defines an aperture;

one or more hazard sensors;

a socket that receives electrical power for operating the hazard detector, the socket comprising:

a socket body having four lateral walls and a rear wall, each of the four lateral walls adjoining two others of the lateral walls, and the rear wall, continuously and airtightly along edges thereof, forming a plug cavity, the socket body forming a mounting flange along edges of the lateral walls that are furthest from the rear wall, and a plurality of electrical pins that pass through the rear wall of the socket body, such that first ends of each of the electrical pins are disposed within the plug cavity, and opposing ends of each of the electrical pins extend away from a rear surface of the socket body;

the socket being coupled with the enclosure such that the mounting flange forms an airtight seal with the enclosure about a periphery of the aperture; and a plug, comprising:

a plug body that forms a plurality of pin sockets, a plurality of contacts corresponding to the plurality of electrical pins, each of the contacts being disposed within a respective one of the pin sockets, a latch spring that mechanically couples with the plug body, and a latch member that mechanically couples with the latch spring, such that as the plug body inserts into the plug cavity:

the electrical pins disposed within the plug cavity insert into the pin sockets and make contact with the contacts, the latch member inserts into a catch cavity of the socket, and the catch feature deflects the latch member.

15. The hazard detector of claim 14, further comprising a gasket that is disposed between, and makes continuous contact with, the mounting flange and the enclosure about the periphery of the aperture to form the airtight seal.

16. The hazard detector of claim 14, further comprising:

a printed circuit board (PCB) that receives the electrical power through the plurality of electrical pins, the PCB being mechanically coupled with the enclosure such that the socket body is disposed between the PCB and the enclosure.

17. The hazard detector of claim 16, the socket further comprising a plurality of assembly keys protruding from the rear wall away from the plug cavity, the PCB defining first holes corresponding to the assembly keys and second holes corresponding to the electrical pins;

wherein when the assembly keys are disposed within the first holes in the PCB, the electrical pins are disposed within the second holes, and the second holes are sized to allow solder fillets to form about the electrical pins within the second holes.

18. The hazard detector of claim 17, the socket further comprising a plurality of stabilizing prongs protruding from the rear wall away from the plug cavity, the PCB defining third holes corresponding to the stabilizing prongs;

wherein when the assembly keys are disposed within the first holes in the PCB, the stabilizing prongs are disposed within the third holes, and the third holes are sized to allow solder fillets to form about the stabilizing prongs within the third holes.

19. The hazard detector of claim 16, the socket further comprising:

a catch feature coupled with the socket body, and a sealing plug; wherein the rear wall forms a molding aperture for the catch feature, and the sealing plug is seated within the molding aperture, the sealing plug and the molding aperture form complementary shapes that constrain the sealing plug from moving toward the catch feature, and the PCB constrains the sealing plug from moving away from the catch feature.

20. The hazard detector of claim 19, wherein the catch feature is supported by a catch support that adjoins two of the lateral walls and divides the plug cavity from the catch cavity within the socket.

* * * * *